US005947470A

United States Patent [19]

Fernandez

[11] Patent Number: 5,947,470

[45] Date of Patent: Sep. 7, 1999

[54] STACKER WITH DISCHARGE CONTROL

[75] Inventor: Jose Ma Villacieros Fernandez, Vigo, Spain

[73] Assignee: Ward Holding Company, Inc., Wilmington, Del.

[21] Appl. No.: 09/185,173

[22] Filed: Nov. 3, 1998

Related U.S. Application Data

[63] Continuation of application No. 08/782,211, Jan. 13, 1997.

[51] Int. Cl.[6] ..... B65H 29/68

[52] U.S. Cl. ..... 271/272; 271/270; 198/462.1; 198/611; 414/793.1

[58] Field of Search ..... 414/793.1, 794.5, 414/794.4, 794.6, 794.8; 198/462.1, 611; 271/182, 272, 270

[56] References Cited

U.S. PATENT DOCUMENTS

| | | | |
|---|---|---|---|
| 4,275,977 | 6/1981 | Joice | 414/793.1 |
| 4,995,859 | 2/1991 | Totani | 271/182 |
| 5,265,861 | 11/1993 | Schaffner et al. | 271/182 |
| 5,417,416 | 5/1995 | Marmin et al. | 271/182 |
| 5,560,595 | 10/1996 | Kulpa | 271/182 |
| 5,855,368 | 1/1999 | Middleberg et al. | 271/272 |
| 5,876,029 | 3/1999 | Wright et al. | 271/270 |

*Primary Examiner*—Christopher P. Ellis
*Assistant Examiner*—Douglas Hess
*Attorney, Agent, or Firm*—Bartlett & Sherer; Ronald B. Sherer

[57] ABSTRACT

This invention relates to a stacking conveyor including slow-down wheels to reduce the exit speed of individual sheets of material. In one preferred embodiment, a non-driven friction drag belt is positioned above the slow-down wheels so as to assist in reducing the discharge velocity of the sheets.

10 Claims, 4 Drawing Sheets

STACKER WITH DISCHARGE CONTROL

RELATED APPLICATION

This Application is a Continuation of Application Ser. No. 08/782,211 filed Jan. 13, 1997.

FIELD OF THE INVENTION

This invention relates to stackers for forming stacks of flat articles such as, for example, container blanks, and more particularly, to a conveyor-stacker which controls the speed at which the blanks are discharged so as to prevent damage to the blanks.

BACKGROUND

In the printing and die cutting of flat articles such as, for example, corrugated sheets or "blanks" which are subsequently folded and glued to form boxes and other forms of containers, it is well known to position a stacker, or so-called "stacker-conveyor," at the discharge of the last section of the printing and/or processing machine; the last section of the production machine usually being a die cutter section which slots the printed container blanks and forms the necessary flaps and tabs. The purpose of the stacker-conveyor is to convey the blanks from the last section of the production machine to a spaced-apart location at which the blanks are stacked upon each other to form vertical stacks which are then banded and removed to a further location for shipping.

Because the printing and/or processing machines, including the die cutter section, operate at very high production speeds such as, for example, at output speeds of 1,000 feet per minute, there has long been a serious problem with the discharge end of the stacker-conveyors. That is, while the conveyor portion may be matched in speed to that of the production machine, the discharge or exit velocities of the blanks are so high that the leading edge of the blanks become seriously damaged as they strike the abutment wall defining the forward vertical line of the stacked pile of blanks. Many prior attempts have been made to solve this problem, but none have been satisfactory.

SUMMARY

The present invention solves this problem by substantially decreasing the final, exit speed of each blank, without scuffing the surface of the blanks, while at the same time controlling the exit angle of the blanks as the discharge end of the stacker-conveyor is raised and lowered throughout the vertical operating range of the stacker-conveyor which may be many feet in height. These and other objects and advantages will become more fully apparent from the following description of one preferred embodiment of the invention as illustrated, by way of example, in the following drawings.

DETAILED DESCRIPTION

Figure 1:
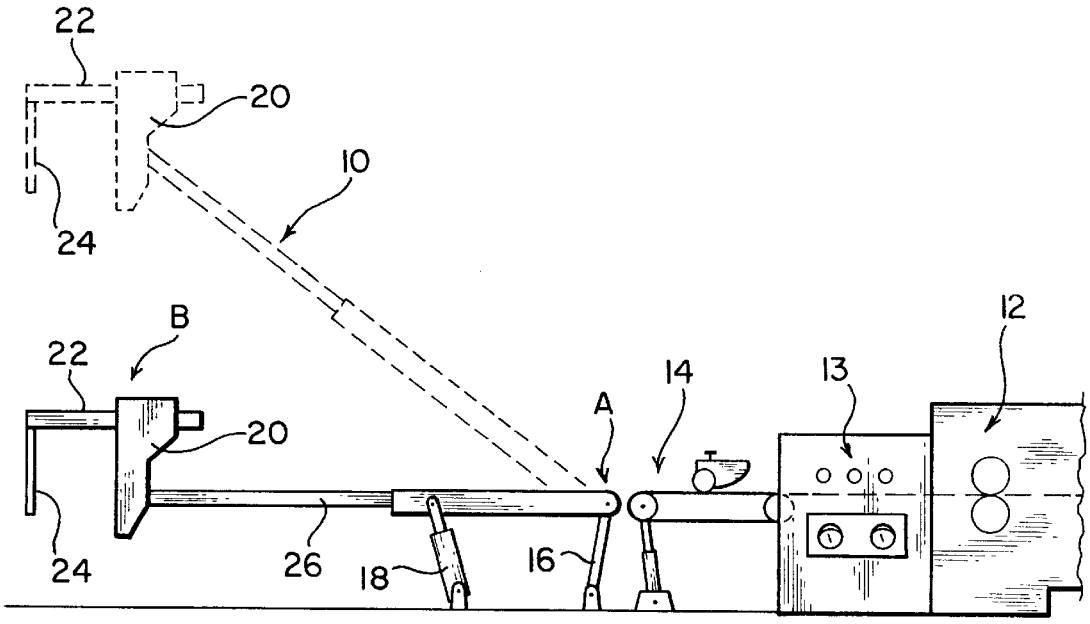
FIG. 1 is a schematic side elevational view of the stacker-conveyor of the present invention positioned at the discharge of a die cutter section.

Referring to FIG. 1, and by way of background, stacker-conveyor 10 is generally preceded by a die cutter section schematically illustrated at 12 which cuts and slots the container blanks to form flaps, tabs and the like. The carton blanks usually pass over an optional vibratory conveyor, not shown, located behind control center 13, and then over a table 14 which may be used to shingle the blanks if desired. The blanks then pass onto inlet end A of the stacker-conveyor 10. Stacker conveyor 10 is pivoted at inlet end A, and is supported by a pivoted connecting rod 16. A pneumatic or hydraulic cylinder 18 is connected at a point spaced from end A such that the stacker-conveyor may be elevated from the horizontal position to the raised position shown in FIG. 1 in dotted line. It will also be understood that because of the articulated nature of connecting rod 16 and cylinder 18, the discharge end B of the stacker-conveyor remains in vertical alignment as the discharge end is raised and lowered throughout its operating range in the course of forming a vertically arranged stack of blanks.

Figure 2:
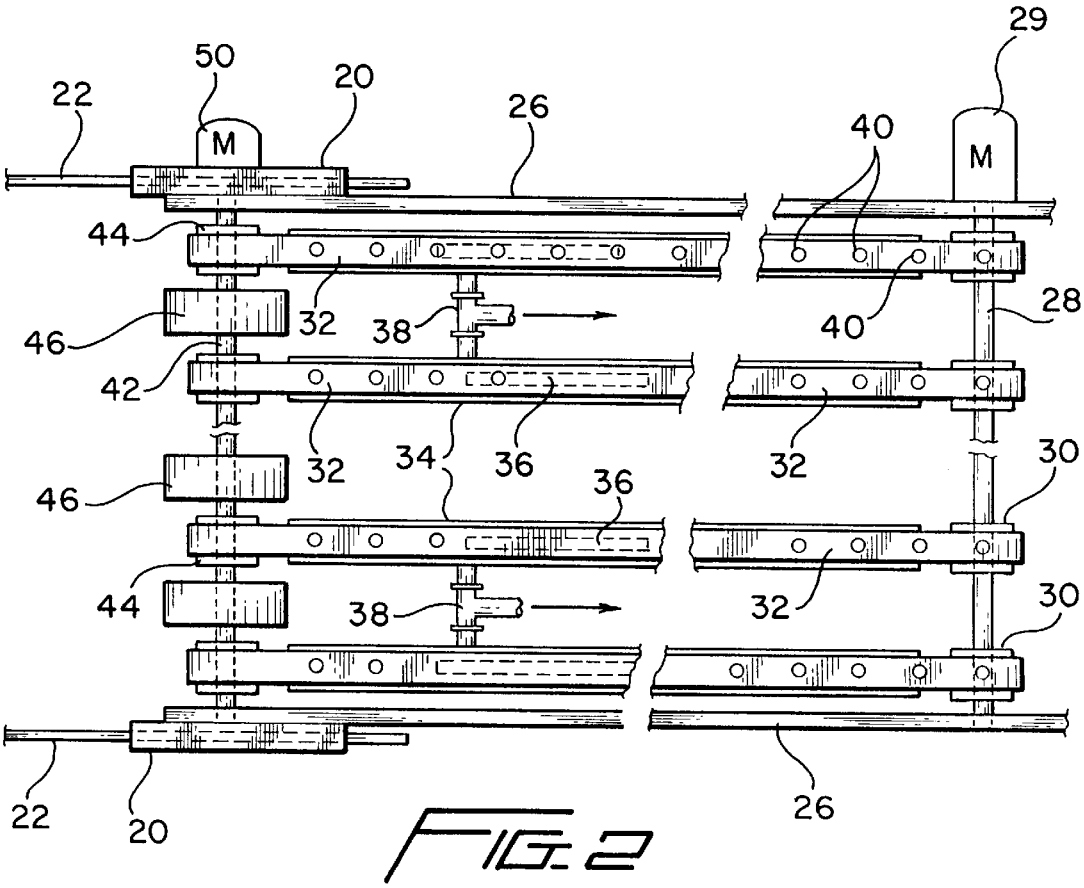
FIG. 2 is a schematic top view looking down on the stacker-conveyor of FIG. 1.

As further shown in FIGS. 1 and 2, the discharge end of the stacker-conveyor carries side-mounted support plates 20 which, in turn, support horizontally extending arms 22. Arms 22 support a vertical wall 24 against which the forward edges of the container blanks abut as they are discharged from the discharge end B of the stacker-conveyor before dropping downwardly onto the stack therebelow. Since the blanks are conveyed and discharged at speeds up to 1,000 feet per minute, it will be apparent that the leading edges of the blanks may be seriously damaged as they abut against wall 24, and it is a principal object of the present invention to prevent such damage to the carton blanks.

The general construction of the stacker-conveyor is illustrated schematically in FIG. 2 which shows a pair of side arms 26 which may be of box-beam construction. As shown in the right-hand portion of FIG. 2, side arms 26 support a drive shaft 28 which is driven by a motor 29. A plurality of drive pulleys 30 are mounted on and driven by shaft 28 and pulleys 30 drive a plurality of parallel-extending conveyor belts 32 spaced across the width of the stacker-conveyor. Side arms 26 also support a plurality of hollow belt-support members 34 which may have square or rectangular cross-section. Members 34 support the underneath side of the upper reaches of the belt and include elongated slots 36; only a few of the slots being shown for purposes of clarity. Hollow belt-support members 34 are connected through hose and fitting assemblies 38 to a source of subatmospheric pressure such as the suction side of a vacuum pump or blower not shown. In this manner, a partial vacuum is created within hollow belt-support members 34, and this partial vacuum is transmitted to the underneath sides of the carton blanks on the conveyor belts through slots 36 in the hollow members and through holes 40 in the conveyor belts. As a result, even though the speed of the conveyor may be as high as 1,000 feet per minute, and even though the angle of the conveyor may be raised as high as 21 degrees with respect to the horizontal, the carton blanks are maintained in tight frictional engagement with the conveyor belts so that the blanks do not slip with respect to the belts.

Figure 3:
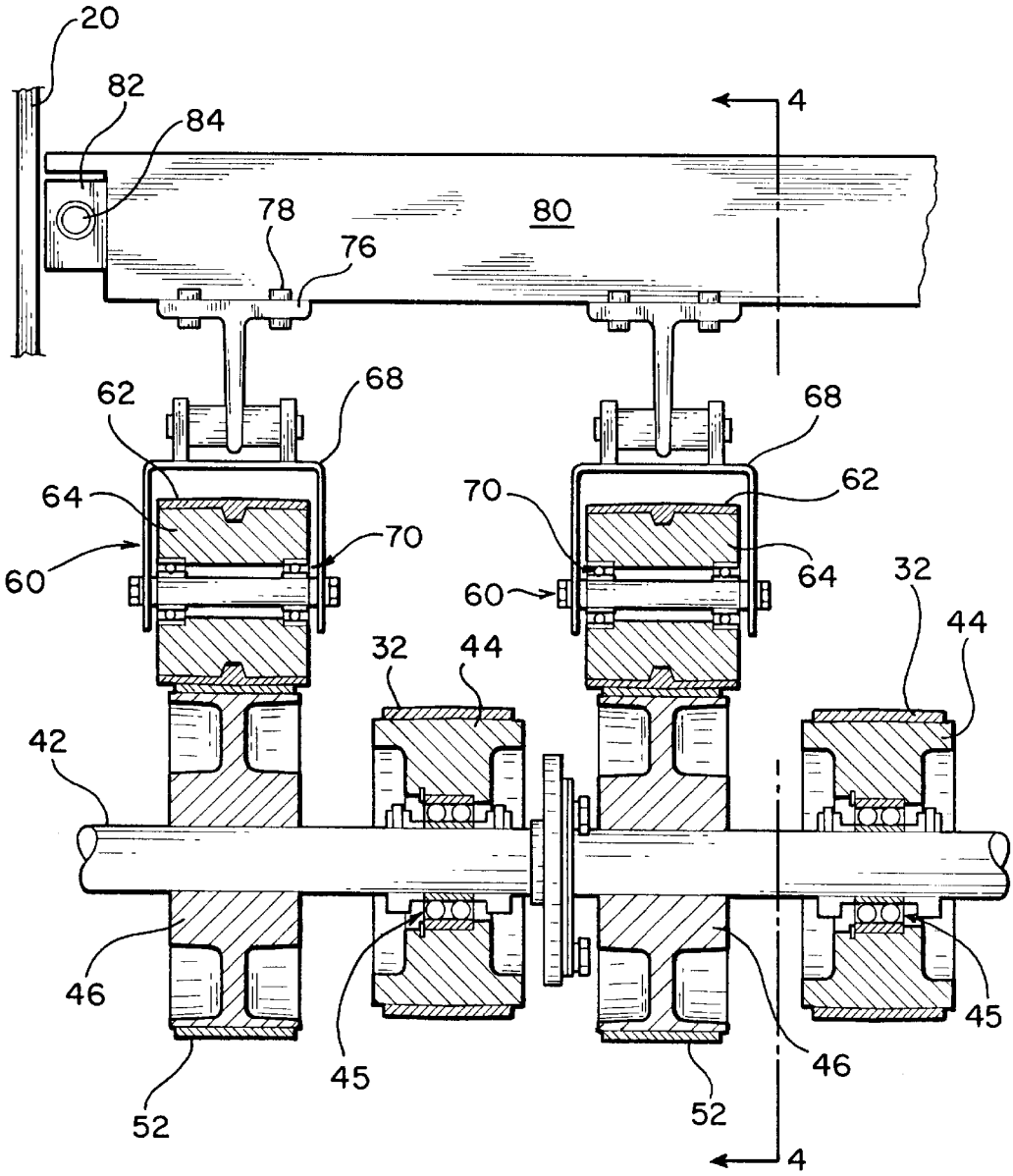
FIG. 3 is a fragmentary end view of the discharge end of the stacker-conveyor of FIGS. 1 and 2.
Figure 4:
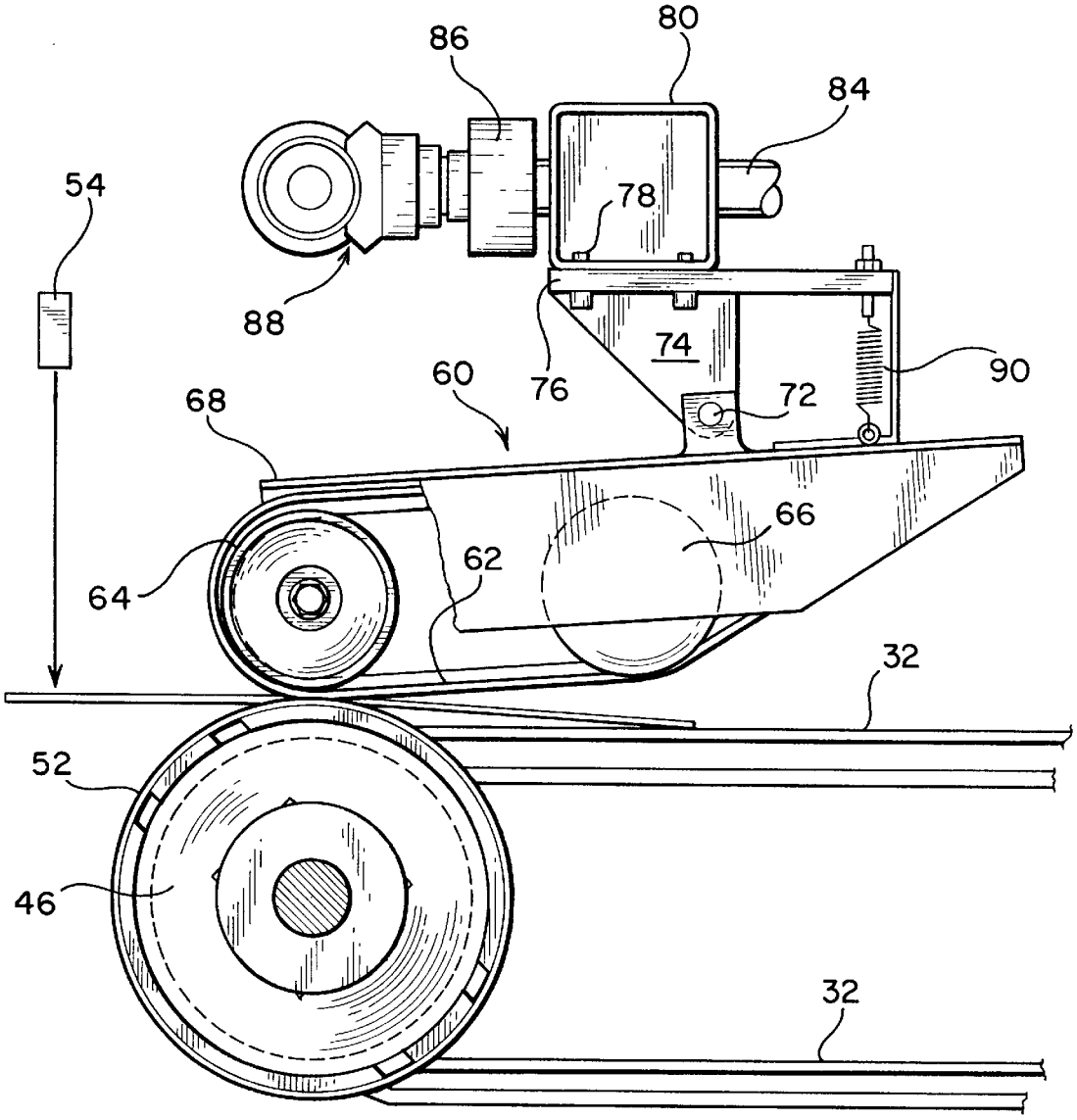
FIG. 4 is a fragmentary side view of the discharge end of the stacker-conveyor taken along view line 4—4 of FIG. 3.

At the discharge end B of the stacker-conveyor as shown in FIGS. 2, 3 and 4, side arms 26 support a second shaft 42 and a plurality of idler pulleys 44 are mounted on shaft 42 by internal bearings 45 so that conveyor belts 32 and idler pulleys 44 are free to rotate at the line speed determined by motor 29 and drive pulleys 30. Shaft 42 also carries a plurality of wheels 46 which are connected to the shaft so as to rotate at a variable speed as determined by variable speed motor 50. It will be noted that the diameters of wheels 46 are larger than the diameters of idler pulleys 44 such that, as shown most clearly in FIG. 4, as the leading edge of each blank passes over wheels 46, the forward portion of the blank is forced or wedged away from belts 32 so that the suction force acting on the bottom of the forward portion of the blank is substantially decreased or eliminated. This forcing or wedging action continues as the blank continues to pass over wheels 46. Thus, depending on the length of the blank and other factors, by the time that about 50% of the blank has passed over wheels 46, which is the position shown for example in FIG. 4, essentially the entire length of the blank is separated from conveyor belts 32. Therefore, at this point, the blank is no longer in contact with or being driven by the belts. However, at this instant, the blank is still moving forward at essentially the line speed of the conveyor belts from which it has just been separated due to the mass and momentum of the blank. Thus, in addition to separating the blanks from the conveyor belts just prior to discharge, it is a further object of the present invention to decrease the exit speed of the blanks as the trailing portion of the blank passes over wheels 46.

This is accomplished by several additional and unique features, the first of which is the provision of high-friction coatings 52 on the surfaces of wheels 46; ie, such as, for example, a rubber-like or high friction plastic coating or band 52 extending about the periphery of wheels 46. High friction coatings 52 engage the bottom surface of each blank as it passes thereover, and the speed of rotation of wheels 46 is controlled by variable speed motor 50 which operates entirely separately from the speed of drive motor 29 and idler pulleys 44. More specifically, as the leading portion of each blank passes over wheels 46, the blank is initially moving at line speed. However, as the leading edge of the blank, or an index mark on the blank, passes under a photocell detector 54 as shown in FIG. 4, a signal is sent through a numerical control system, or other type of computer control, to variable speed motor 50. The computer control is pre-programmed with the length of the blank such that, after a predetermined length of the blank has passed beyond the detection point, the speed of motor 50 and wheels 46 is substantially reduced. This immediately reduces the velocity of the blank significantly. For example, motor 50 may be reduced in speed, from the line speed, by a factor of 80% or more such that the blank exits the stacker-conveyor with a velocity approaching zero.

As further shown in FIGS. 3 and 4, the discharge velocity of each blank is also retarded by a plurality of drag belt assemblies 60; one of such assemblies being mounted above each of wheels 46. Each drag belt assembly comprises a belt 62 of relatively high friction material extending about first and second pulleys or rollers 64, 66. Rollers 64, 66 are preferably mounted in an inverted U-shaped housing 68 and are journaled for rotation in bearings 70. Housing 68 is preferably pivotally connected at point 72 to a vertical support plate 74 having a horizontally extending base 76 which is connected, as by bolts 78 or other means, to a horizontally and laterally extending support 80. Thus, support 80, which may be a box-beam as illustrated or other shape of support member, carries all of the plurality of drag belt assemblies 60 which extend across the width of the stacker-conveyor. At each end, one of which ends being shown in FIG. 3, support 80 terminates in a threaded carrier 82 which is mounted on a threaded shaft 84. Shaft 84 is driven through a coupling 86 and a right-angle gear drive 88 by a servo motor or manually operated drive not shown. It will be understood that such motor or manual drive and support bearings for shaft 84 may be mounted to support plate 20 or be otherwise supported as desired. Accordingly, all of drag belt assemblies 60 may be moved in unison by support 80 forwardly or rearwardly with respect to wheels 46 as will be described in further detail hereinafter. It will also be noted that tension springs 90 are connected at their lower ends to housings 68 and at their upper ends to support bases 76 such as to resiliently bias the portion of belts 62 around forward rollers 64 into frictional engagement with slow-down wheels 46 and into engagement with the upper surfaces of the blanks whenever a blank is discharged between drag belts 62 and slow-down wheels 46.

The function of drag belt assemblies is three-fold. First, as just mentioned, the drag belt assemblies engage the upper surfaces of the blanks as they are discharged and force the lower surfaces of the blanks firmly against the high-friction coatings 52 on slow-down wheels 46 so that, as the speed of wheels 46 is reduced, the discharge velocity of the blanks is substantially reduced. Secondly, the drag belt assemblies themselves further add to the decrease of discharge velocity of the blanks due to their inertia and the frictional resistance of the rollers and belts, and particularly as the belts are forced to flex and rotate about the rollers by virtue of the energy imparted to the belts by the blanks. Stated otherwise, some of the kinetic energy of the blanks is transferred to, and absorbed by, the drag belts in causing the drag belts to flex and rotate about the rollers.

Figure 5B:
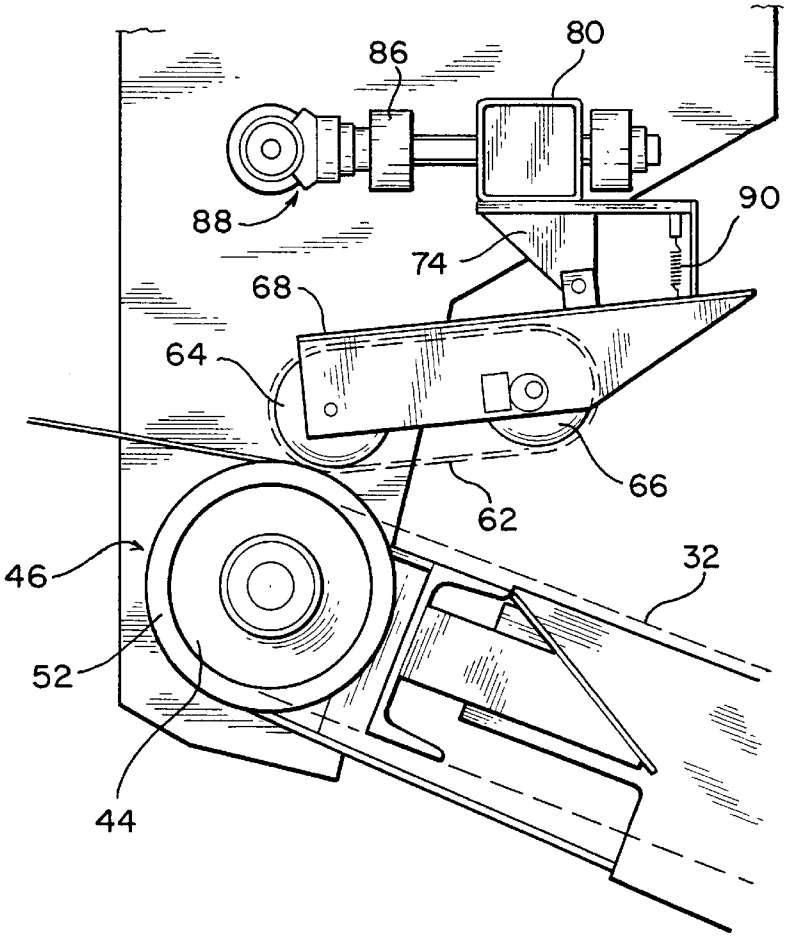
FIGS. 5A and B are schematic side elevational views showing different positions of the drag belt assemblies relative to the discharge end of the conveyor.
Figure 5A:
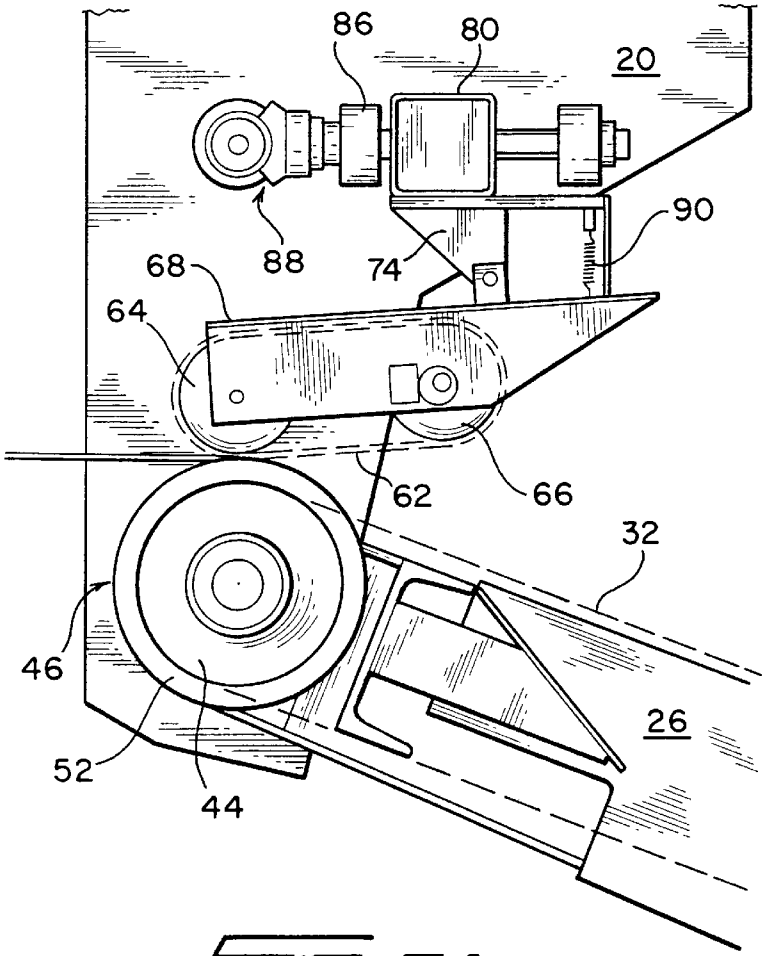

Thirdly, drag belt assemblies 60 perform the critical function of determining the exit angle of the blanks as the trailing edge of each blank leaves contact with wheels 46 and the drag belts. As shown in FIGS. 5A and B, the exit angle of the blanks relative to the horizontal may be controlled by varying the forward or rearward position of drag belt assemblies 60 relative to wheels 46. As shown in FIG. 5A, the exit angle of the blanks may be made to be zero by positioning forward roller 64 such that drag belt 62 contacts wheel 46 at the top dead center portion of the wheel. The blank then exits horizontally between drag belt 62 and wheel 46. Alternatively, depending upon the warp of the blanks, it may be desirable to have the blanks exit at a more upwardly inclined angle, such as at an angle of 5 or 10 degrees with respect to the horizontal. If this is desired, the drag belt assemblies may be moved rearwardly such that drag belt 62 contacts wheel 46 at a position which is lower and more rearwardly of the top dead center portion. In this event, the blank exits at an upwardly inclined angle such as illustrated in FIG. 5B. Alternatively, if the blanks are warped upwardly, it may be desired to discharge them at a slight downward angle. This may be accomplished by moving the drag belt assemblies forwardly such that roller 64 is positioned forward of, and lower than, the top dead center position of wheels 46. In this position, the blanks may be discharged at a negative angle of 5 to 10 degrees as desired.

From the foregoing description of one preferred embodiment of the invention, it will be apparent that the present invention solves the problem of damage to the leading edges of the blanks even though they may be discharged at line speeds of up to 1,000 ft./min. In addition, the present invention enables the blanks to be discharged at zero degrees throughout the range of elevation of the discharge end, or the operator may select positive or negative angles as desired. It will also be apparent to those skilled in the art that numerous variations in the details of the illustrated embodiment are possible without departing from the principles of the present invention. For example, holes 40 in the conveyor belts may be eliminated, if desired, by the use of porous belts known in the conveyor art. Alternatively, separate vacuum ducts may be positioned between the belts, and the upper reaches of the belts may be supported by other means such as separate support strips as is generally known in the conveyor art. Similarly, drag belts 62 may be replaced by coatings on rollers 64 and rollers 66 may be eliminated, preferably with increased friction on the rotation of coated rollers 64 so as to provide the desired drag force. Therefore, it is to be understood that the foregoing description of one preferred embodiment is intended to be purely illustrative of the principles of the invention, rather than exhaustive thereof, and that the invention is not intended to be limited other than as set forth in the following claims as interpreted under the doctrine of equivalents.

What is claimed is:

1. A stacker-conveyor for stacking blanks comprising:

(a) first and second sets of conveyor pulleys spaced apart along a longitudinal direction of said conveyor between an inlet end and a discharge end;

(b) a plurality of conveyor belts extending around said first and second sets of conveyor pulleys;

(c) said plurality of conveyor belts and said first and second sets of conveyor pulleys being spaced apart laterally at substantially right angles to said longitudinal direction;

(d) a plurality of slow-down wheels mounted between said laterally-spaced second conveyor pulleys for slowing down said blanks as said blanks pass over second set of conveyor pulleys; and (e) wherein said second set of pulleys and said slow-down wheels are mounted on a common axis.

2. The stacker-conveyor of claim 1 wherein the diameter of said slow-down wheels is larger than the diameter of said second set of conveyor pulleys whereby said slow-down wheels force said blanks away from said conveyor belts.

3. The stacker-conveyor of claim 1 wherein said laterally-spaced second conveyor pulleys are mounted for rotation about a common axis, said common axis extending at substantially a right angle to said longitudinal direction, and wherein said slow-down wheels are mounted for rotation about said common axis.

4. The stacker-conveyor of claim 3 including a drive shaft, said slow-down wheels being mounted for rotation with said shaft, and journal means mounting said second conveyor pulleys on said shaft for rotation relative to said shaft.

5. The stacker-conveyor of claim 4 including variable speed motor means for rotating said shaft at variable speeds.

6. The stacker-conveyor of claim 5 including sensor means for sensing the discharge position of said blanks and for actuating said variable speed motor means to drive said slow-down wheels at a reduced speed as each blank is discharged.

7. The stacker-conveyor of claim 1 including partial vacuum producing means connected to each of said plurality of conveyor belts for producing a partial vacuum for drawing said blanks into firm engagement with said conveyor belts.

8. The stacker-conveyor of claim 7 wherein the diameter of said slow-down wheels is larger than the diameter of said second set of conveyor pulleys for forcing said blanks away from said conveyor belts as said blanks are discharged.

9. A stacker-conveyor for conveying and stacking corrugated sheets comprising:

(a) first and second sets of conveyor pulleys spaced apart along a longitudinal direction of said conveyor between an inlet end and a discharge end;

(b) a plurality of porous conveyor belts extending around said first and second sets of conveyor pulleys;

(c) vacuum chamber means operatively associated with said porous belts for drawing said corrugated sheets into tight frictional engagement with said porous belts;

(d) said plurality of porous conveyor belts and said first and second sets of conveyor pulleys being spaced apart laterally at substantially right angles to said longitudinal direction;

(e) a plurality of slow-down wheel means mounted between said laterally-spaced second conveyor pulleys for engaging said corrugated sheets, said slow-down wheel means being of larger diameter than said pulleys, and for engaging and forcing said sheets away from said porous belts and vacuum chamber means and for slowing down said sheets as they pass over said second conveyor pulleys; and (f) non-driven friction drag belt means positioned directly above said second conveyor pulleys for engaging said sheets simultaneously with the engagement by said slow-down wheel means as said corrugated sheets pass over said second conveyor pulleys.

10. The stacker-conveyor of claim 9 wherein said drag belt means comprise two non-driven friction drag pulleys and a drag belt extending about said non-driven friction pulleys.

* * * * *